US005950423A

United States Patent [19]

Hampton

[11] Patent Number: 5,950,423

[45] Date of Patent: Sep. 14, 1999

[54] IN-LINE EXHAUST SYSTEM FOR A TRANSVERSE MOUNTED V-ENGINE

[75] Inventor: Leslie E. Hampton, Corning, N.Y.

[73] Assignee: Corning Incorporated, Corning, N.Y.

[21] Appl. No.: 09/099,667

[22] Filed: Jun. 18, 1998

Related U.S. Application Data

[60] Provisional application No. 60/051,122, Jun. 27, 1997.

[51] Int. Cl.[6] ..... F01N 3/00

[52] U.S. Cl. ..... 60/274; 60/300; 60/302; 60/284; 422/177

[58] Field of Search ..... 60/274, 284, 297, 60/300, 302, 323; 422/171, 172, 176, 177

[56] References Cited

U.S. PATENT DOCUMENTS

| | | | |
|---|---|---|---|
| 4,671,059 | 6/1987 | Lawson | 60/309 |
| 5,138,834 | 8/1992 | Maund et al. . | |
| 5,233,830 | 8/1993 | Takeshima et al. . | |
| 5,265,420 | 11/1993 | Rutschmann . | |
| 5,365,735 | 11/1994 | Weber et al. | 60/323 |
| 5,538,697 | 7/1996 | Abe et al. . | |
| 5,787,706 | 8/1998 | Smedler et al. | 60/288 |
| 5,787,707 | 8/1998 | Hertl et al. | 60/297 |

FOREIGN PATENT DOCUMENTS

| | | | |
|---|---|---|---|
| 4127633 | 2/1993 | Germany | 60/323 |

*Primary Examiner*—Edward K. Look
*Assistant Examiner*—Binh Tran
*Attorney, Agent, or Firm*—Timothy M. Schaeberle

[57] ABSTRACT

An in-line exhaust system for a v-configured transverse-mounted internal combustion engine includes a first passage for a first exhaust gas stream and a second passage for a second exhaust gas stream having a catalyst system disposed therein. An hydrocarbon adsorber structure having an inlet and outlet end, a desorption temperature and comprising a first substantially unobstructed flow region, and a second more obstructed flow region abutting the first region, is provided and positioned so that both the first and second exhaust gas streams are able to flow therethrough. A fluidics diverter is provided and disposed in the second exhaust gas stream upstream, and proximate to the first region, of the adsorber for diverting the second exhaust gas stream away from the said first region. The system additionally includes a burn-off catalyst disposed downstream from the adsorber.

6 Claims, 3 Drawing Sheets

IN-LINE EXHAUST SYSTEM FOR A TRANSVERSE MOUNTED V-ENGINE

This application claims the benefit of U.S. Provisional Application No. 60/051,122, filed Jun. 27, 1997, entitled IN-LINE EXHAUST SYSTEM FOR A TRANSVERSE MOUNTED V-ENGINE, by Leslie E. Hampton.

BACKGROUND OF THE INVENTION

1. Field of the Invention

This invention relates to in-line exhaust system for an v-configured, transverse-mounted internal combustion engine having a front manifold having a first exhaust stream and a rear manifold rear having a second exhaust stream.

2. Description of the Prior Art

At the present time, automotive exhaust systems equipped with catalytic conversion systems generally comprise an exhaust line connecting with a converter housing, the housing enclosing a ceramic or metal honeycomb substrate supporting an oxidation or, more commonly, a three-way emissions control catalyst. The three-way catalyst operates to oxidize carbon monoxide and unburned hydrocarbons present in the exhaust stream and, with proper control of exhaust stream stoichiometry, to at least partially reduce higher oxides of nitrogen (NOx) contained therein.

Tightened emissions standards for automotive gasoline engines have placed higher demands on the performance of these catalytic conversion systems. Particularly critical for overall system performance is performance during the so-called "cold start" phase of engine operation. This is the period of engine operation covering approximately the first 60 seconds after cold engine start and prior to startup or "light off" of the catalytic converter, during which the highest concentrations of unburned hydrocarbons are released into the atmosphere.

One type of exhaust system designed specifically to address the cold-start problem provides a hydrocarbon adsorber in the exhaust line. The adsorber operates to trap unburned hydrocarbons emitted during engine startup, and then to release those hydrocarbons to a catalytic converter after converter light-off has been achieved. A preferred configuration for an adsorber in such systems is a honeycomb structure, similar in construction to a catalyst support honeycomb but composed of, or supporting, a coating of a hydrocarbon adsorbent such as carbon, zeolite, or another adsorber material.

Examples of recently developed cold-start engine emissions control systems of this type are disclosed in published patent applications WO 95/18292, EP 0661098 and EP 0697505 (Hertl et al). Two further examples of such system are described in copending, commonly assigned U.S. patent application Ser. No. 08/578,003 (Brown et al.) filed Dec. 22, 1995 and entitled "Exhaust System with a Negative Flow Fluidics Apparatus" and U.S. patent application Ser. No. 08/685,130 of J. Anderson et al. filed Jul. 24, 1996 and entitled "Exhaust Gas Fluidics Apparatus".

A common feature of "in-line" systems is a ported honeycomb adsorber, i.e., an adsorber comprising a by-pass port integral with its structure, located downstream of a main or light-off catalytic converter but positioned upstream of a second or so-called "burn-off" catalytic converter. This adsorber functions to trap the hydrocarbons released at engine startup and slowly desorb and release the hydrocarbons to the burn-off converter as the adsorber is heated by the warming exhaust gases. A particular advantage of the ported adsorber design is the faster light-off of the burn-off converter due to exposure of that converter to the hot exhaust gases passing directly through the adsorber port. In the design of Hertl et al., Brown et. al. and Anderson et al., control over the flow of the exhaust gases through or past the adsorber is secured by means of a fluidic diverter which delivers a control gas stream for diverting the exhaust gases toward or away from the adsorber port in the course of engine operation.

V-engines mounted in the transverse position generate two exhaust gases which exhibit two different temperatures when combined together at some point prior to entering a main exhaust pipe. The exhaust coming from the front manifold is cooled as a result of heat loss along the length of a crossover pipe which runs from the front of the engine towards the back and is generally 3 to 4 feet in length. The exhaust from the rear manifold travels a much lesser distance, generally less than a foot, prior reaching a junction where it is mixed with the exhaust from the front manifold. As such, the exhaust gas from the rear manifold exhibits a much higher temperature at the point where the gases are mixed. At this point the temperatures typically differ by as much as 150° C. and as a result, the overall temperature of the mixed exhaust stream is greatly reduced when compared to the single stream of the aforementioned systems described above. Incorporation of the aforementioned in-line exhaust systems at a position downstream of the junction would therefore result in a inefficient configuration which would exhibit a delayed light-off of the main catalyst, when compared to the aforementioned single stream systems. As such, incorporation of these in-line exhaust systems into v-engines, as described would result in an exhaust system which would exhibit poor overall exhaust purification performance.

SUMMARY OF THE INVENTION

An object of the invention is to provide an in-line exhaust system for a v-configured, transverse-mounted internal combustion engine which exhibits quick lightoff of the main catalyst.

This object can be attained by an in-line exhaust system for a v-configured transverse-mounted internal combustion engine in accordance with the present invention. The system includes the following: (1) a first passage for the front manifold first exhaust gas stream and a second passage for the rear manifold second exhaust gas stream having a catalyst system disposed therein; (2) a hydrocarbon adsorber structure having an inlet and outlet end, a desorption temperature and comprising a first substantially unobstructed flow region, and a second more obstructed flow region abutting the first region, the adsorber being positioned so that both the first and second exhaust gas streams are able to flow therethrough; (3) a fluidics diverter disposed in the second exhaust gas stream upstream, and proximate to the first region, of the adsorber for diverting the second exhaust gas stream away from said first region; and, (4) a burn-off catalyst disposed downstream from the adsorber.

DETAILED DESCRIPTION OF THE INVENTION

Figure 1:
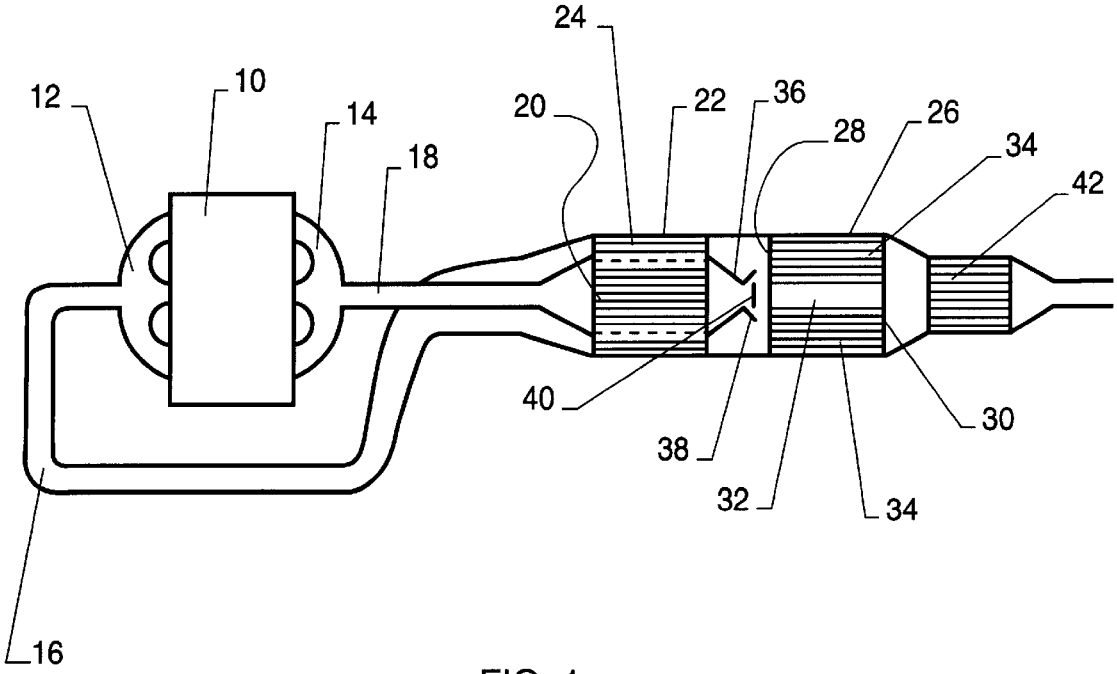
FIG. 1 is a schematic system diagram of the in-line exhaust system of a transverse mounted v-engine in accordance with a first embodiment of the present invention.

FIG. 1 illustrates a configuration of an in-line exhaust system in accordance with a first embodiment of the invention. As illustrated in FIG. 1 a transverse mounted v-configured internal combustion engine 10 is provided having a front manifold 12 having a first exhaust gas stream and a rear manifold 14, having a second exhaust gas stream. A first passage 16 is provided for the first exhaust gas stream and a second passage 18 is provided for the second exhaust gas stream. The outlet of the second passage 18 is diverged and positioned proximate to central portion of a catalyst system such that the second exhaust gas stream is prevented from entering the peripheral portion of the catalyst system and is instead caused to enter and travel through the center portion; i.e., the center cells 20 of a main catalytic converter 22 in this embodiment. The first passage 16 travels under the internal combustion engine 10 and wraps around the outside of the second passage 18. The wrapping of the first passage around the second passage serves to insulate the second exhaust gas stream against heat loss while the first exhaust gas stream experiences heat loss due to the exterior environment. The outlet of the first passage 16 allows the first exhaust gas stream to enter and pass through the peripheral cells 24 of the main catalytic converter 22. As a result of the distance traveled and the insulation of the second passage, the temperature of the first exhaust stream upon entering the adsorber is considerably lower than the temperature of the second exhaust gas stream entering the catalyst system.

Downstream of the main catalytic converter 22 is positioned a hydrocarbon adsorber structure 26 having an inlet 28 and outlet 30 end, a desorption temperature and comprising a first substantially unobstructed flow region 32, and a second more obstructed flow region 34 abutting the first region 32. The adsorber being positioned so that both the first and second exhaust gas stream streams are able to flow therethrough and be adsorbed at temperatures below the adsorbers' desorption temperature.

Positioned at the exit end of the main catalytic converter 22 is an extension 36 of the second passage 18 which initially converges and then includes a flared outlet 38; the outlet is positioned proximate to the inlet of the adsorber first region 32. The positioning and shape of the outlet functions to direct the second exhaust gas stream away from the adsorber first region 32. Furthermore, a fluidics diverter 40 is positioned in the second exhaust gas stream upstream, and proximate to the first region 32, of the adsorber 26. The second passage extension's flared outlet 38 and the fluidics diverter 40, when activated, combine to divert the first and second exhaust gas streams away from the first region 32 and into the second region 34 whereupon any hydrocarbons in the gases are adsorbed at temperatures below adsorber desorption temperature.

Lastly the system includes a burn-off catalyst 42 which is disposed downstream from the adsorber which serves to catalyze the hydrocarbons of both exhaust gas streams which may be desorbed by the adsorber after it has reached its desorption temperature. It is important to design the adsorber, i.e., its volume, mass and size of the first region, such that the burn-off catalyst reaches lightoff prior to the adsorber reaching its desorption temperature; i.e., the system should be such that the desorption is delayed until the burn-off catalyst has reached its lightoff temperature.

In this embodiment because the second exhaust gas stream will be directed to a central region of the main catalyst and the first exhaust gas stream will be directed through the peripheral region, the center region of the catalyst will achieve a much quicker light-off when compared to systems where the high/low exhaust gases are mixed prior to entering the main catalyst. This as a result of the fact that the second exhaust gas stream which flows from the rear manifold is much hotter when it enters the catalyst than if it was mixed with the first exhaust gas stream which flows from the front manifold and is much cooler at the same downstream position. If the fluidics diverter is activated, the second exhaust gas stream, once passing through the central region will be directed through the second region of the adsorber where the hydrocarbons are adsorbed. On the other hand, if the fluidics diverted is deactivated the second exhaust gas stream will flow directly through the first region thereby causing the burn-off catalyst to more quickly reach its lightoff temperature than if the second exhaust gas stream gas is forced to flow through the adsorber cells in the periphery. After passing through the peripheral cells of the main catalyst, the first exhaust gas stream will pass through the adsorber whether fluidics diverter is activated or deactivated; the hydrocarbons in this first exhaust gas stream being continuously adsorbed until the adsorber reaches its desorption temperature. This continuous flow of the first exhaust gas stream through the adsorber serves to delay the adsorber reaching its desorption temperature, as a result of its cooler temperature, thereby ensuring that the burn-off catalyst reaches its lightoff temperature first.

Figure 2:
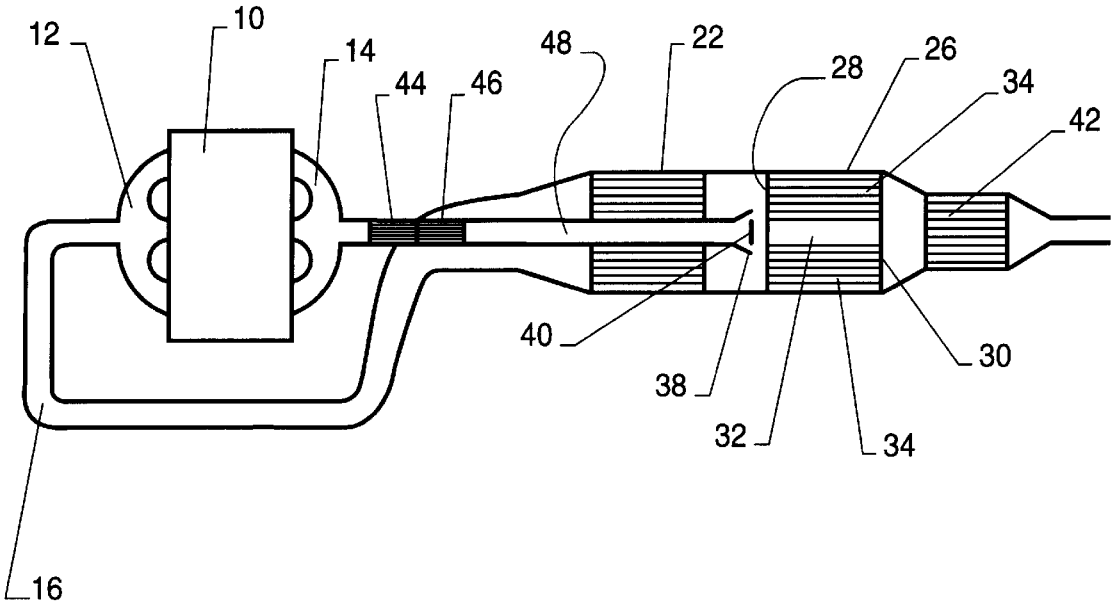
FIG. 2 is a schematic system diagram of the in-line exhaust system of a transverse mounted v-engine in accordance with a second embodiment of the present invention.
Figure 3:
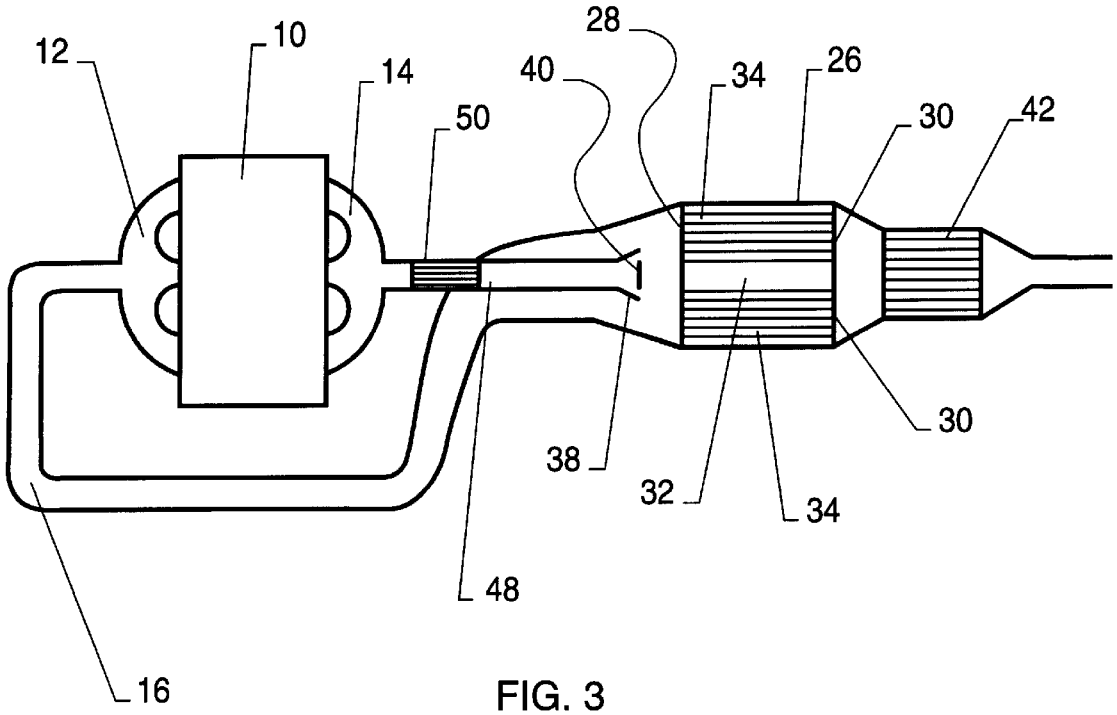
FIG. 3 is a schematic system diagram of the in-line exhaust system of a transverse mounted v-engine in accordance with a third embodiment of the present invention.

FIGS. 2 and 3 illustrate arrangements of in-line exhaust systems for transverse mounted v-engines in accordance with a second and third embodiments of the invention, respectfully. Since the main difference of the second and third embodiments when compared to the first embodiment is in the structure of the catalyst system, and the shape of the second exhaust passage like portions of the of the second and third embodiments having the same structure as those of the first embodiment will be denoted by like numerals.

Referring to FIG. 2, the second embodiment, the catalyst system for the second exhaust gas stream comprises a series of two close coupled catalytic converters, 44 and 46 which effectively replace the center of the main catalyst in the first embodiment. The close-coupled catalyst structures are placed as close as is possible to the exhaust ports of the engine to thereby reduce the distance the second exhaust gas stream must travel after leaving the engine's rear manifold and to minimize the heat loss therefrom. The second exhaust gas passage 48, straight in this embodiment, continues through the main catalytic converter 22, and extends to a position proximate to the first region of the adsorber 26. As in the first embodiment, the second exhaust passage 48 possesses a flared outlet 38 which combines with the fluidics diverter 40 to direct the second exhaust gas stream toward the second region of the adsorber. The advantage that this embodiment exhibits over the first embodiment is that the low mass/low volume close-coupled catalyst series is located at the hottest place in the second exhaust gas stream. As such, the catalyst system reaches its catalyst light-off temperature faster when compared to the main catalyst of the first embodiment. The rest of the exhaust system of the second embodiment, the first exhaust passage 16, the adsorber 26, fluidics diverter 40 and the burn-off catalyst 42, are configured like those described above for the first embodiment.

In the third embodiment, as detailed in FIG. 3 the catalyst system for the second exhaust gas stream is comprised of a single close-coupled catalyst 50 which replaces the main catalyst of the first embodiment. In this embodiment, the system is designed to ensure that the temperature drop of the first exhaust gas stream and the volume of the adsorber are such that the burn-off catalyst achieves light-off in a short enough period of time to thereby make unnecessary the need for a main catalyst between the front manifold and the adsorber. In effect, the system design is such that the burn-off catalyst is positioned closer to the second exhaust gas stream gas source, the rear manifold, when compared to the earlier embodiments, and thus the second exhaust gas exhaust stream exhibits a higher temperature when it reaches the bum-off catalyst; i.e., a quicker light-off. Similar to the second embodiment, the second gas passage 48 exhibits the following characteristics: (1) it is straight and extends to a position proximate to the first region of the adsorber 26; and, (2) it possesses a flared outlet 38 which combines with the fluidics diverter 40 to direct the second exhaust gas stream toward the second region of the adsorber. Again, the rest of the exhaust system of this embodiment, the first exhaust gas stream passage 16, the adsorber 26, the fluidics diverter 40 and the burn-off catalyst 42 are configured like those described above for the first embodiment.

It should be noted that although the above embodiments are described in terms of a transverse mounted v-engine, the invention described herein could easily be applied to any non-transverse internal combustion engine having two exhaust gas streams having different temperatures, both of which are to be catalyzed.

The operation of the above systems all function in the generally the same manner, as follows. Prior to the catalyst system being active (i.e., catalyst lightoff) the second exhaust gas stream is caused to flow through the first passage and through the catalyst system and thereafter diverted into the second region of the adsorber by activating the fluidics diverter which combines with the flared outlet of the second exhaust passage to cause the diversion of the stream. The lower temperature exhaust is able to, but is not required to flow through the catalyst system, however these lower temperature exhaust gases are necessarily caused to flow through the second region of the adsorber whereupon the hydrocarbons in these gases are adsorbed. After the catalyst system has reached its lightoff temperature the fluidics diverter is deactivated and the second exhaust gas stream is allowed to flow through the first region of the adsorber. Allowing these hot gases to travel through the first region of the adsorber serves to quickly cause the burn-off catalyst to reach its lightoff temperature. At some point after the bum-off catalyst has reached its lightoff temperature, the adsorber reaches its desorption temperature and the adsorbed hydrocarbons of both the first and second temperature gases, are desorbed.

For the purpose of removing harmful components such as HC, CO, $NO_x$ and the like discharged from the internal combustion engine, the catalyst, main or close-coupled, preferably comprises a honeycomb substrate structure of a heat-resistant inorganic material coated with a catalyst layer of a heat-resistant oxide containing at least one noble metal selected from Pt, Pd and Rh.

The honeycomb substrate structure can be any material suitable for high temperature application such as certain metals, metal alloys, ceramics, glass-ceramics, glass, high surface area-high temperature stable oxides, and combinations of these materials. Examples of useful substrate materials include, cordierite, mullite, clay, talc, zircon, zirconia, spinel, alumina, silica, borides, lithium aluminosilicates, alumina silica, feldspar, titania, fused silica, nitrides, carbides and mixtures of these. Useful metals for the substrate include, substrates formed of iron group metals such as Fe-Al, Fe-Cr-Al alloys, stainless steel, and Fe-Nickel alloys. Preferably, the material of the honeycomb structure, is cordierite, in view of its heat resistance and thermal shock resistance.

Each of these noble metals is used by being supported on a heat-resistant oxide such as $Al_2O_3$, $SiO_2$, $TiO_2$, or $ZrO_2$, or its heat-resistant oxide. It is particularly preferable to use, as the heat-resistant oxide, an $AL_2O_3$ having a specific area of 100 $m^2/g$ or more, because the oxide can support the noble metal in highly dispersed state and the resulting catalyst layer of the honeycomb structure can have improved low-temperature ignition property and heat resistance.

The adsorber is preferably a honeycomb structure of the above mentioned heat-resistant inorganic material coated with an adsorbent layer. Useful adsorbent layer materials for the invention include silicates (such as the metallosilicates and titanosilicates) of varying silica-alumina ratios, metalloaluminates (such as germaniumaluminates), metallophosphates, aluminophosphates (such as silico- and metalloaluminophosphates (MeAPO), SAPO, MeAPSO), gallogerminates and combinations of these. Examples of useful metallosilicates include zeolites, gallosilicates, chromosilicates, borosilicates, ferrisilicates. Examples of zeolites which are particularly useful for the invention include, ZSM-5, Beta, ginelinite, mazzite, offretite, ZSM-12, ZSM-18, Berryllophosphate-H, boggsite, SAPO-40, SAPO-41, and combinations of these, most preferably, ZSM-5, Beta, Ultra-stable Y (USY), and mordenite. For such applications, zeolites having high silica/alumina ratios (greater than 10), are more thermally stable and are therefore preferred. Furthermore, it is contemplated that applications maintained under reducing conditions, activated carbon may be the material of choice.

The adsorber layer can be applied onto the honeycomb substrate structure by any known method such as, for example, conventional washcoating or spraying techniques. In the washcoat technique, the substrate is contacted with a slurry containing the adsorber material and other components such as temporary binders, permanent binders or precursors, dispersants and other additives as needed. Such methods are well known in the art. The permanent binder in the slurry includes, for example, aluminum oxide and its precursors, silica, titania, zirconia, rare earth oxides and their precursors, spinel and precursors. The adsorber slurry is then applied (for example, by repeated spraying or dipping) to the substrate until the desired amount of adsorber material has been applied. One useful method for forming zeolite on the surface of a substrate is disclosed in U.S. Pat. No. 3,730,910, herein incorporated by reference.

It is well known that during cold start, adsorbers, zeolites specifically not only trap hydrocarbons but also cause cracking of some hydrocarbons (i.e., coking). To prevent coking, the adsorber may be catalyzed with suitable catalysts. As is well known in the art, noble metal oxidation catalysts such as platinum, rhodium, and palladium, may be added to zeolite adsorber to ensure oxidation of the carbonaceous materials which may result from coking. Any catalyst capable of converting hydrocarbons to water and carbon dioxide may be added to the zeolite. Such catalysts are well known in the art. For example, noble metal catalysts, such as platinum, rhodium, palladium, and mixtures of these are widely used in automotive catalytic converters. These catalysts are capable not only of oxidizing hydrocarbons but also of converting carbon monoxide and NOx in the engine exhaust stream to innocuous products. Such catalysts may be incorporated into the adsorber or adsorber structure by known methods. It is also known that certain zeolite/noble metal combinations such as disclosed in co-assigned U.S.

Pat. No. 5,244,852 (herein incorporated by reference) function as three-way catalysts to convert.

In another useful embodiment, the adsorber is a zeolite in the form of a porous monolithic structure formed by extruding the zeolite into a honeycomb structure. U.S. Pat. No. 4,381,255, herein incorporated by reference, discloses a process for producing binderless zeolite extrudates by extruding a mixture containing equal amounts of a zeolite powder, a metakaolin clay and a near stoichiometric caustic solution, in which the clay in the extrudate crystallizes to form a coherent particle that is essentially all zeolite. Similarly, U.S. Pat. No. 4,637,995, herein incorporated by reference, discloses a method for preparing a monolithic zeolite support comprising a ceramic matrix having zeolite dispersed therein.

U.S. Pat. No. 4,631,267, herein incorporated by reference, discloses one method for producing a monolithic zeolite structure by (a) mixing into a substantially homogeneous body (i) a zeolite, (ii) a precursor of a permanent binder for the zeolite selected from the group consisting of alumina precursors, silica precursors, titania precursors, zirconia precursors and mixtures of these, and (iii) a temporary binder; and extruding the mixture to form a porous monolithic adsorber structure.

The adsorber can also be formed by in situ growth of zeolite, that is, by crystallizing zeolite on the surface of a metal, metal alloy, ceramic, or glass ceramic substrate. A method for crystallizing strong-bound zeolites on the surfaces of monolithic ceramic substrates is disclosed in U.S. Pat. No. 4,800,187, herein incorporated by reference.

Depending on the particular application, the engine exhaust system of the invention can be constructed with any one or a combination of fluidics diverters. For example an exhaust system can include a tubular air injection port having a plurality of cone-shaped directional nozzles, an air injection collar having a plurality of nozzles, a tubular air injection port possessing a cone-shaped air injection nozzle, a tubular injection port possessing a diverter body, an air injection tube, an air "knife" as well as combinations of these. It is self evident that for each of the fluidic diverter listed above each would possess a diversion fluid source.

Although a few embodiments of the invention have been described in detail above, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

I claim:

1. An in-line exhaust system for a v-configured, transverse-mounted internal combustion engine having a front and rear manifold, the front having a first exhaust gas stream and the rear having a second exhaust gas stream, the exhaust system comprising:

a first passage for the first exhaust gas stream;

a second passage for the second exhaust gas stream having a catalyst system disposed therein;

an adsorber structure having an inlet and outlet end, a desorption temperature and comprising a first substantially unobstructed flow region, and a second more obstructed flow region abutting the first region, the adsorber being positioned so that both the first and second exhaust gas streams flow therethrough;

a fluidics diverter disposed in the second exhaust gas stream upstream, and proximate to the first region, of the adsorber for diverting the second exhaust gas stream away from said first region;

a burn-off catalyst disposed downstream from the adsorber.

2. An exhaust system according to claim 1 wherein the catalyst system comprises a series of close-coupled catalysts positioned adjacent each other.

3. An exhaust system according to claim 1 wherein the catalyst system comprises a single close-coupled catalyst.

4. An exhaust system according to claim 1 wherein the catalyst system comprises a single main catalyst.

5. An exhaust system according to claim 4 wherein the second exhaust passage is positioned to cause the second exhaust gas stream to flow through a central portion of the main catalyst and the first exhaust gas passage is positioned to cause the first exhaust gas stream to flow through the peripheral portion of the main catalyst.

6. A method of treating the exhaust of a v-configured, transverse-mounted internal combustion engine having a front and rear manifold, the front having a first exhaust gas stream and the rear having a second exhaust gas stream, comprising:

(a) causing the first exhaust stream gas to flow through an adsorber having an inlet and outlet, a desorption temperature, and a first substantially unobstructed flow region, and a second more obstructed flow region abutting the first region, whereby the first exhaust stream gas is caused to flow through the second more obstructed region of whereupon the adsorber adsorbs hydrocarbons from the first exhaust gas stream;

(b) causing the second exhaust gas stream to flow through a catalyst system and activating a fluidics diverter which causes the second exhaust stream to flow through the second region of the adsorber structure whereby the adsorber adsorbs the hydrocarbons in the second exhaust stream;

(c) causing the first and second exhaust gas stream to flow through a burnoff catalyst having a lightoff temperature;

(d) after lightoff of the catalyst system, deactivating the fluidics diverter, thereby causing a substantial portion of the second exhaust gas stream to flow towards, and into the first region of the adsorber;

(e) after lightoff of the burn-off catalyst desorbing the adsorbed hydrocarbons of the first and second exhaust gas stream.

* * * * *